US008348076B2

(12) United States Patent
Rader et al.

(10) Patent No.: US 8,348,076 B2
(45) Date of Patent: Jan. 8, 2013

(54) COLLAPSIBLE CONTAINER WITH LOCKING DEVICE

(75) Inventors: Henning Rader, Middleburg, VA (US); Hans Niemann, Winchester, VA (US)

(73) Assignee: Monoflo International, Inc., Winchester, VA (US)

( * ) Notice: Subject to any disclaimer, the term of this patent is extended or adjusted under 35 U.S.C. 154(b) by 759 days.

(21) Appl. No.: 12/186,928

(22) Filed: Aug. 6, 2008

(65) Prior Publication Data

US 2010/0031712 A1 Feb. 11, 2010

(51) Int. Cl.
*B65D 6/00* (2006.01)
*B65D 8/14* (2006.01)

(52) U.S. Cl. ..... 220/7; 229/171; 229/125; 229/175; 70/63

(58) Field of Classification Search ..... 220/7, 326; 206/1.5; 229/175, DIG. 38, 125, 171, 141, 229/38, DIG. 16, DIG. 29; 70/63
See application file for complete search history.

(56) References Cited

U.S. PATENT DOCUMENTS

| | | | | |
|---|---|---|---|---|
| 3,724,889 | A * | 4/1973 | Dooley | 292/87 |
| 4,798,304 | A * | 1/1989 | Rader | 220/6 |
| 5,038,953 | A | 8/1991 | Radar | |
| 5,205,595 | A * | 4/1993 | Svehaug | 292/175 |
| 6,868,979 | B2 * | 3/2005 | Rader | 220/7 |
| 7,370,771 | B2 | 5/2008 | Rader | |

* cited by examiner

*Primary Examiner* — J. Gregory Pickett
*Assistant Examiner* — Blaine Neway
(74) *Attorney, Agent, or Firm* — Nixon & Vanderhye P.C.

(57) ABSTRACT

A collapsible container includes a main frame and at least one pivotable side wall that is pivotable between a collapsed position and an opened position. The pivotable side wall is provided with a spring lock insert secured therein and biased toward a lock position in which a lock portion of the spring lock insert extends beyond an end edge of the pivotable side wall. The main frame includes a latch opening that receives the spring lock insert when the pivotable side wall is in the opened position.

7 Claims, 5 Drawing Sheets

COLLAPSIBLE CONTAINER WITH LOCKING DEVICE

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The invention relates to a collapsible container and, more particularly, to a collapsible container including a locking device that releasably secures at least one of the side walls in an upright, opened position.

Collapsible plastic containers are used in a variety of industrial and commercial applications. These containers offer the convenience of large holding capacity and, when collapsed, a minimum space requirement for storage. Exemplary collapsible plastic containers are described in commonly-owned U.S. Pat. Nos. 5,038,953 and 7,370,771, the disclosures of which are incorporated by reference.

Existing collapsible containers typically operate in a similar manner. A top perimeter and bottom accept the attachment of sidewalls that are hinged to allow the entire assembly to be folded. Generally, the longer sides are constructed with two parts hinged in the middle and attached to both the top perimeter and bottom. The shorter sides or end walls are attached to the top perimeter or bottom and fold inward to collapse the container.

In most containers of this type, the side attached to a single component is secured in position only by a ramp or bump, past which its moving end passes as it swings into final position. This function may be accomplished in a similar fashion via cantilevered snaps. Other containers use an additional part to provide a sliding latch. It is important to positively retain these sides in their fully erect position to ensure that the container can bear the weight of containers that may be stacked on top of it.

BRIEF SUMMARY OF THE INVENTION

The design according to the described embodiments incorporates a spring-locking device preferably located in the end panel that engages the main frame of the container when the container is erected. The locking device is preferably of a one-piece design with spring characteristics and is easily installed in the panel. The locking device secures the panel in its full vertical position and is easily released when desired to enable the container to be collapsed.

In an exemplary embodiment, a collapsible container includes a main frame; a bottom wall; and a plurality of side walls, where at least one of the plurality of side walls is pivotable between a collapsed position and an opened position. The pivotable side wall includes at least one spring lock insert secured in a slot in the pivotable side wall and biased toward a lock position in which a lock portion of the spring lock insert extends beyond an end edge of the pivotable side wall. The main frame comprises at least one latch opening corresponding to the at least one spring lock insert. The latch opening receives the spring lock insert when the pivotable side wall is in the opened position.

The lock portion of the spring lock insert preferably includes an angled surface facing the main frame such that the spring lock insert is displaced away from the lock position by engagement of the angled surface with the main frame until the pivotable side wall is pivoted to the opened position.

In one arrangement, the spring lock insert is formed in a one-piece integrated construction. Preferably, the spring lock insert is provided with a finger grip that is sized to receive a human finger.

The spring lock insert may include a pair of spring extensions disposed at an angle relative to a bias direction of the spring lock insert, where a width of the slot in the pivotable side wall is smaller than a width span of the spring extensions. In this context, the spring extensions are preferably deflectable inward to enable the spring lock insert to be displaced downward away from the lock position.

The pivotable side wall may also include a release channel disposed adjacent the slot. The release channel houses the spring lock insert and includes sufficient space to enable the spring lock insert to be displaced from the lock position.

Preferably, the plurality of side walls comprises two lateral walls and two end walls, where the end walls are pivotable between the collapsed position and the opened position. Moreover, each of the end walls may include two spring lock inserts secured in corresponding slots therein, where the main frame includes a latch opening for each of the spring lock inserts.

In another exemplary embodiment, a collapsible container includes a main frame; a bottom wall; and a plurality of side walls including a pair of lateral walls and a pair of end walls, where the end walls are pivotable between a collapsed position and an opened position. Each of the end walls includes at least one spring lock insert secured in a slot therein that is biased toward a lock position in which a lock portion of the spring lock insert extends beyond an end edge of the end wall. The main frame includes a latch opening corresponding to each of the at least one spring lock insert. The latch opening receives the spring lock insert when the pivotable side wall is in the opened position.

BRIEF DESCRIPTION OF THE DRAWINGS

These and other aspects and advantages will be described in detail with reference to the accompanying drawings, in which.

DETAILED DESCRIPTION OF THE INVENTION

Figure 1:
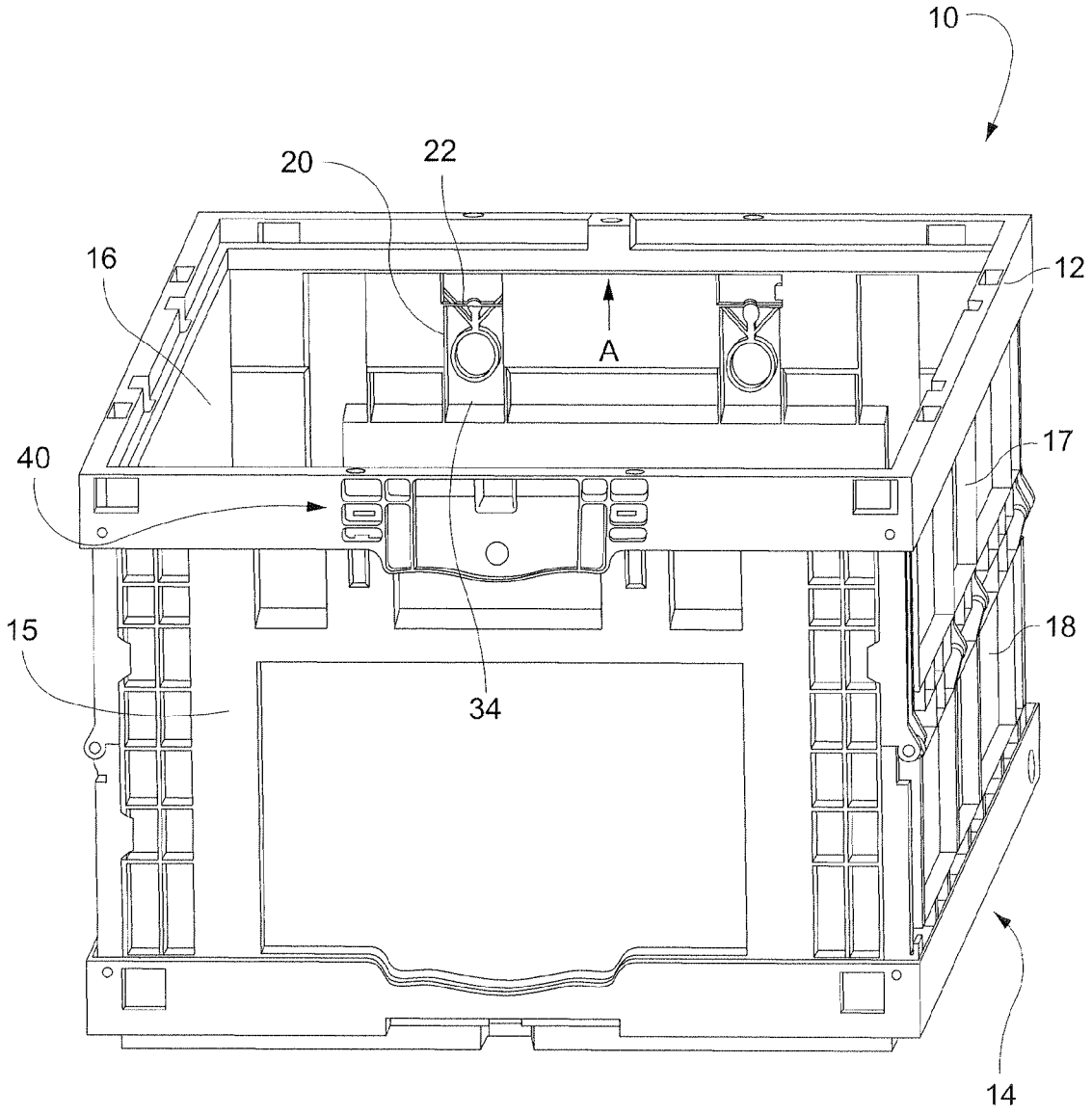
FIG. 1 is an end perspective view of the container in an assembled or opened position.

With reference to FIG. 1, a collapsible container 10 is movable from a collapsed position to an opened position. The generally conventional elements of the container 10 include an open top frame or top perimeter 12, a bottom panel 14, two ends or end panels 15 and two sides 16. Each of the sides is composed of first and second panels 17, 18 that are pivotably connected together at a center portion of the sides 16 as shown. The first panels 17 are pivotably connected to the top frame 12, and the second panels 18 are pivotably connected to the bottom 14 so that the first and second panels pivot with respect to each other and the top frame and bottom about parallel axes.

Figure 2:
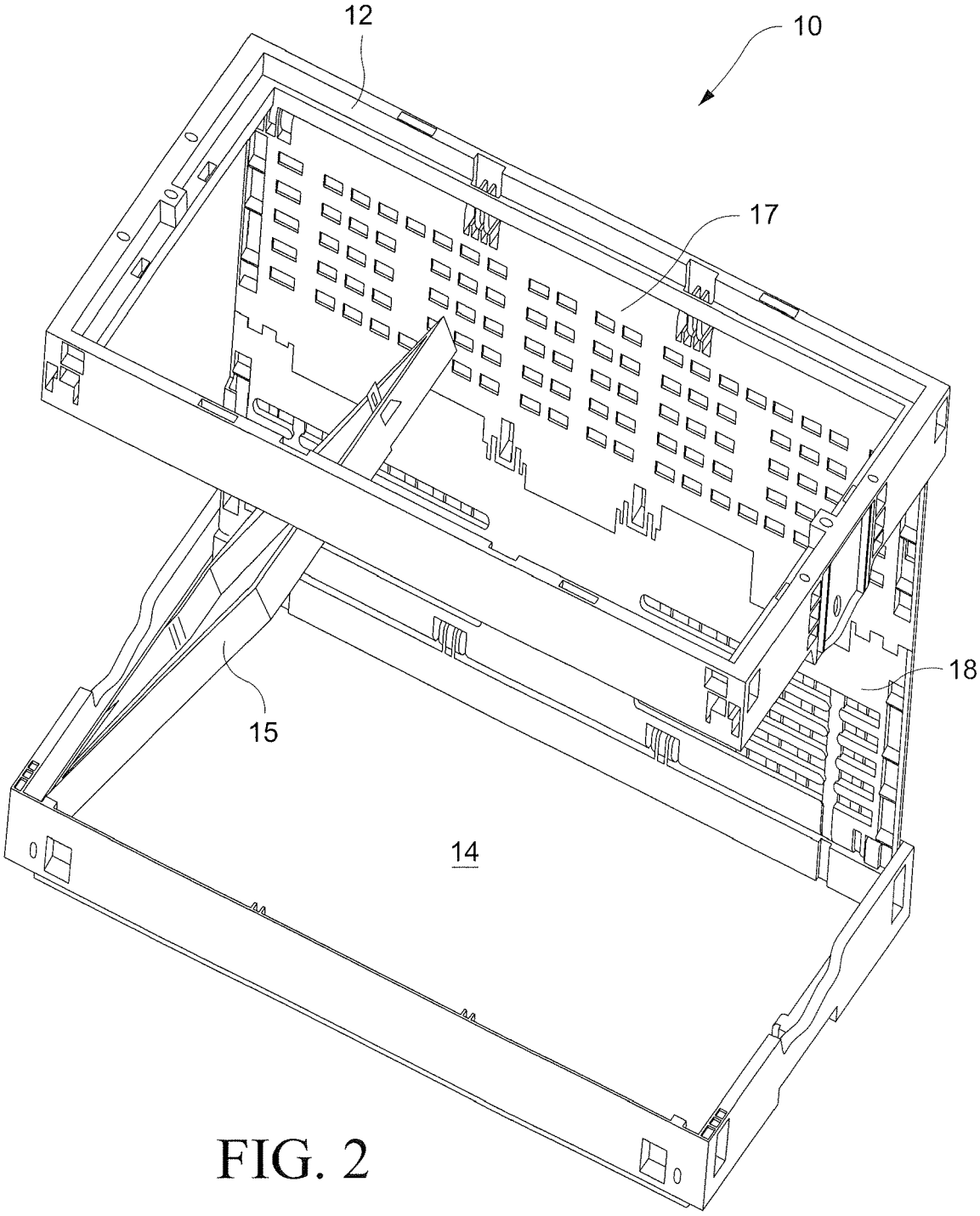
FIG. 2 is a partial perspective view showing an end panel between a collapsed position and an opened position.
Figure 3:
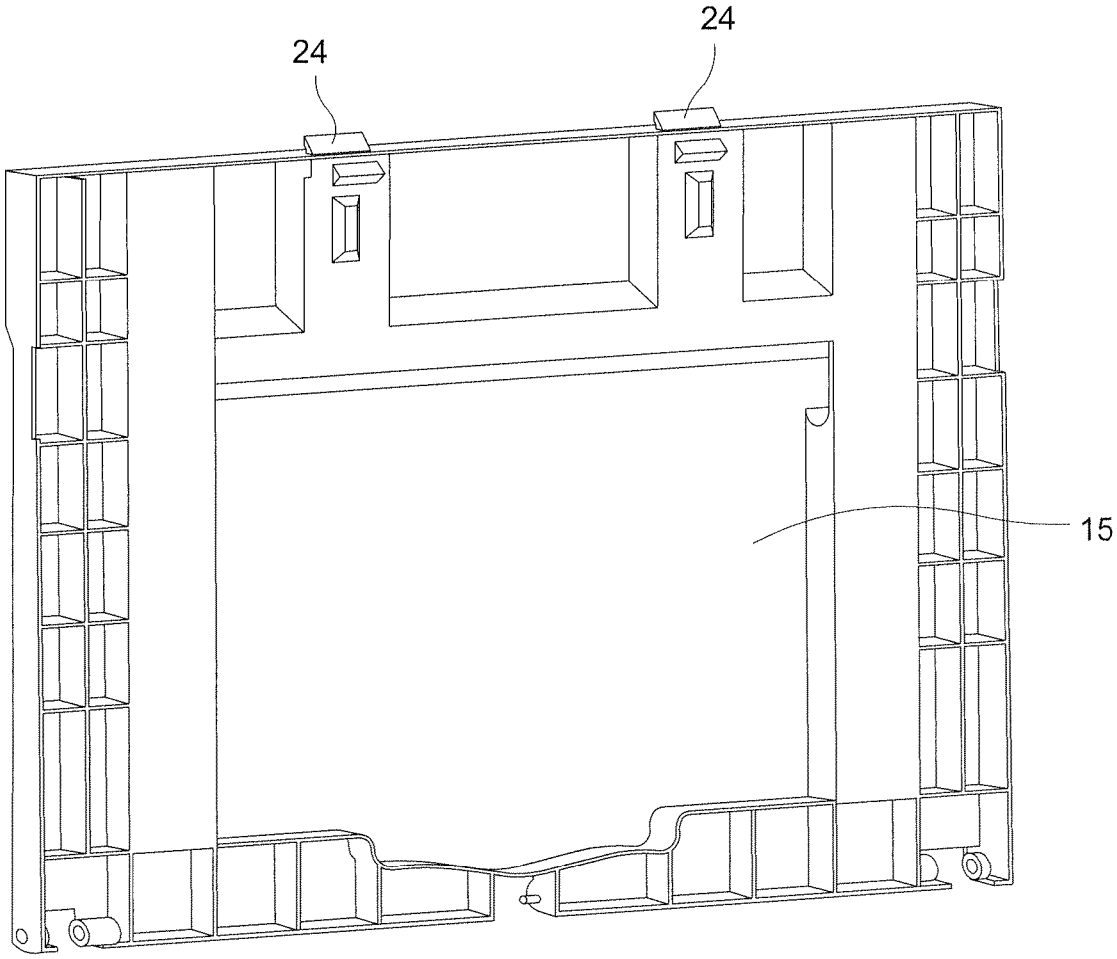
FIG. 3 is an exterior view of an end panel including a pair of spring lock inserts.
Figure 4:
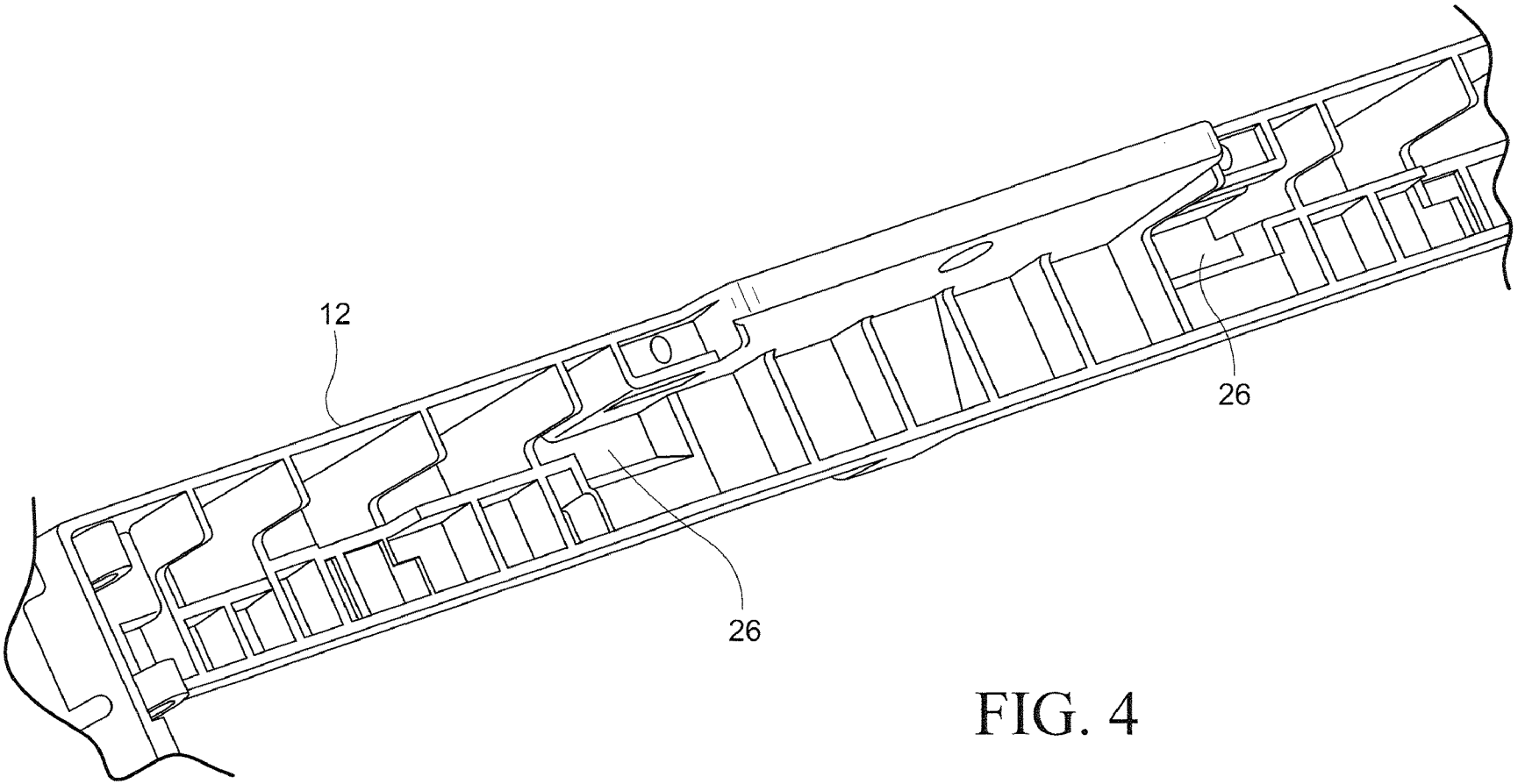
FIG. 4 shows a pair of latch openings in the main frame that accepts the spring lock inserts when the panel is in its full vertical position.

With reference to FIG. 2, the pivotable end walls 15 are pivotably connected to the bottom 14 via a hinge or other suitable connection. Each of the end walls 15 is preferably provided with at least one spring lock insert 20 secured in a slot 22 in the end wall 15 and biased toward a lock position in which a lock portion 24 of the spring lock insert 20 extends beyond an edge of the end wall 15 (see FIG. 3). The top frame 12 is provided with a latch opening 26 (FIG. 4) for each of the spring lock inserts 20 that receives the lock portion 24 of the spring lock inserts 20 when the end wall 15 is in its opened position. The spring lock inserts 20 fully engage the frame when the end panel 15 is in its full vertical position. A small opening 40 (FIG. 1) in the outside of the frame 12 can be used to allow visual confirmation that the end panel is fully engaged. A small opening in the outside of the end panel 15 can also be used to allow visual confirmation that the spring lock insert 20 is present.

Figure 5:
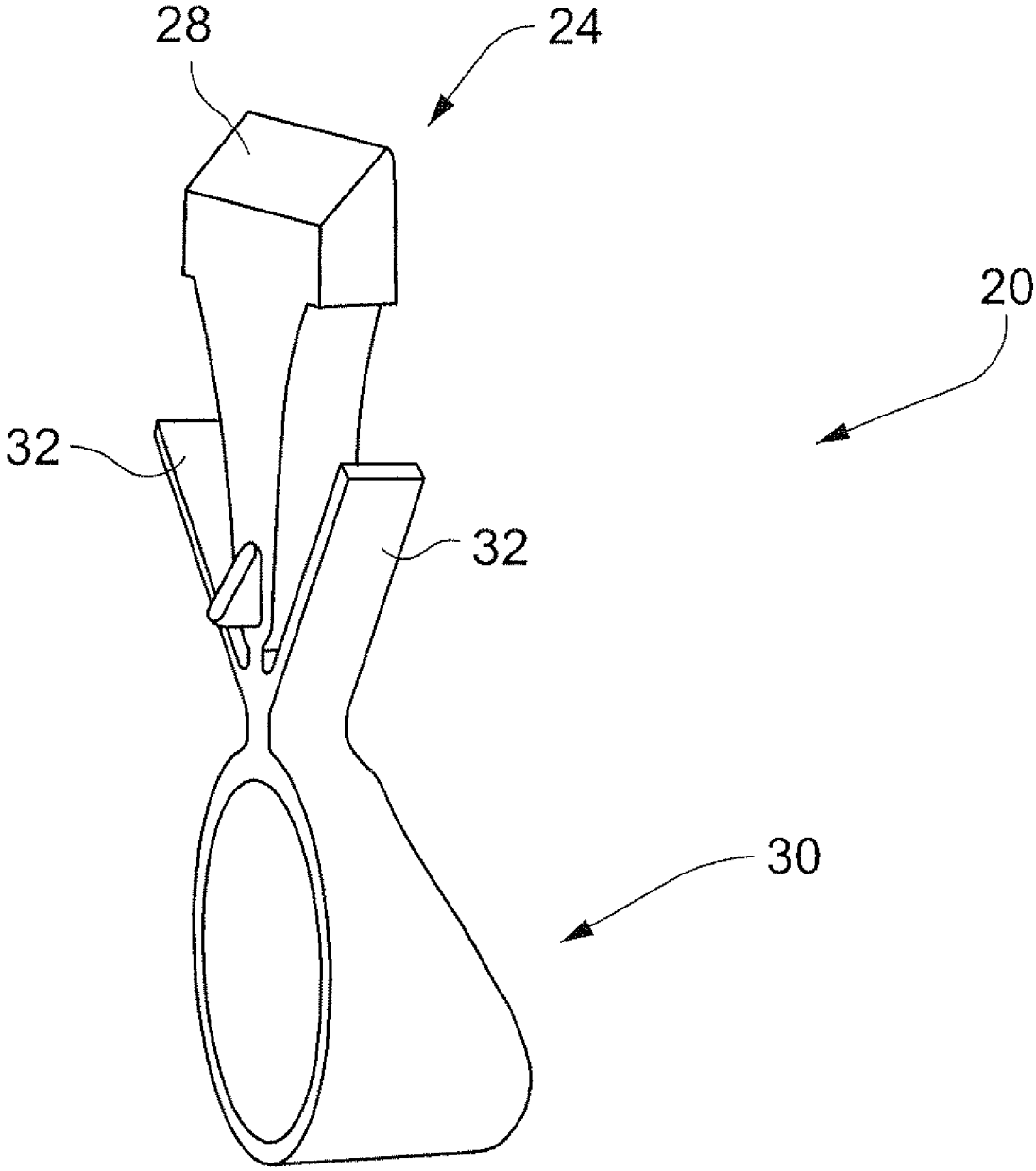
FIG. 5 is a perspective view of a spring lock insert.

With reference to FIG. 5, the lock portion 24 of the spring lock insert 20 preferably includes an angled surface 28 facing the top frame 12 such that the spring lock insert 20 is displaced away from the lock position by engagement of the angled surface 28 with the top frame 12 until the end wall 15 is pivoted to its opened (vertical) position. As shown in FIG. 5, the spring lock insert 20 is preferably formed in a one-piece integrated construction. The spring lock insert 20 includes a finger grip 30 that is sized to receive a human finger (which could also be accomplished with a different shape, for example, a tab protruding up) and facilitates release of the spring lock insert 20. The spring lock insert 20 also includes a pair of spring extensions 32 disposed at an angle relative to a bias direction of the spring lock insert 20 (see arrow A in FIG. 1). A width of the slot 22 in the end wall 15 is smaller than a width span of the spring extensions 32. With continued reference to FIG. 1, the end wall 15 includes a release channel 34 disposed adjacent the slot 22. The release channel 34 houses the spring lock insert 20 and includes sufficient space to enable the spring lock insert to be displaced from its lock position. The spring extensions 32 are deflectable inward to enable the spring lock insert 20 to be displaced within the release channel 34 via the finger grip 30 away from the lock position (downward in FIG. 1).

With reference to FIG. 2, when the container is being opened from its collapsed position, as the end panel 15 begins to engage the top frame 12, the angled surface 28 of the lock portion 24 makes contact with the frame 12 and is pushed away from the locked position (downward in FIG. 1) under tension into the end panel 15. As the end panel 15 continues to move into its full vertical position, it reaches an area under the frame 12 that contains the latch opening 26 to accept the lock portion 24 of the spring lock insert 20. At this time, the tension placed on the spring lock insert 20 via the spring extensions 32 urges the lock portions 24 into the latch openings 26, thereby securely locking the end panel 15 into the frame 12. To disengage the end panel 15 from the frame 12, the spring lock inserts 20 are displaced in the release channel 34 on the inside of the container (downward in FIG. 1). With the spring lock inserts 20 released, the end panel 15 can be moved toward its horizontal position, and the container can be collapsed.

It will be appreciated by those of ordinary skill in the art that a suitable locking function could be obtained with only a single spring lock insert 20 in the end panel 15. Additionally, the container 10 may be constructed such that the side panels 16 include the spring lock inserts instead of or in addition to the end panels 15. Moreover, although the end panels 15 are shown pivoting on the bottom 14 into the top frame 12, the end panels 15 could alternatively pivot from the top frame 12 into suitable structure in the bottom panel 14. The spring lock could also be located in the frame 12 and engage the end panel 15.

With the container constructed according to the described embodiments, a secure engagement of the end panel to the frame can be achieved that positively holds the end panel in place when the container is erected. Additionally, a smooth, flat top edge of the end panel with a chamfered edge allows for easy and smooth automated container set up. Since the spring lock inserts can only be disengaged from the inside of the erected container, the end panel cannot be pushed in when the containers are stacked and/or lidded. This provides a very high level of security when the stacked or lidded containers are strapped or banded. Still further, the design allows the container to accept a variety of different lids while still providing the security necessary to protect the contacts from pilferage. The spring lock inserts allow for a non-violent, user-friendly way for the user to disengage the end panel from the frame and collapse the container when it is empty. The container design allows it to be used and is interchangeable with other similar containers and lids available in the market.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A collapsible container comprising:

a main frame;

a bottom wall; and a plurality of side walls, at least one of the plurality of side walls being pivotable between a collapsed position and an opened position, wherein the pivotable side wall includes at least one spring lock insert secured in a slot in the pivotable side wall, the at least one spring lock insert including a lock portion displaceable in the slot between a lock position in which the lock portion of the spring lock insert extends from the slot and beyond an end edge of the pivotable side wall and toward which the at least one spring lock insert is biased and a release position, wherein the slot in the pivotable side wall and the at least one spring lock insert are substantially coplanar such that the at least one spring lock insert is displaceable in the slot substantially within a planar volume defined by the slot, wherein the main flame comprises at least one latch opening corresponding to the at least one spring lock insert, the latch opening receiving the spring lock insert when the pivotable side wall is in the opened position, wherein the spring lock insert comprises a finger grip that is sized to receive a human finger, the finger grip facilitating displacement of the spring lock insert from the lock position to the release position, and wherein the spring lock insert comprises a pair of spring extensions disposed at an angle relative to a bias direction of the spring lock insert, the spring extensions extending from the finger grip in a diverging direction toward the lock portion, wherein a width of the slot in the pivotable side wall is smaller than a width span of the spring extensions, and wherein the spring extensions extend through the planar volume defined by the slot.

2. A collapsible container according to claim 1, wherein the lock portion of the spring lock insert comprises an angled surface facing the main frame such that the spring lock insert is displaced away from the lock position by engagement of the angled surface with the main frame until the pivotable side wall is pivoted to the opened position.

3. A collapsible container according to claim 1, wherein the spring lock insert is formed in a one-piece integrated construction.

4. A collapsible container comprising:

a main frame;

a bottom wall; and a plurality of side walls, at least one of the plurality of side walls being pivotable between a collapsed position and an opened position, wherein the pivotable side wall includes at least one spring lock insert secured in a slot in the pivotable side wall, the at least one spring lock including a lock portion displaceable in the slot between a lock position in which the lock portion of the spring lock insert extends from the slot and beyond an end edge of the pivotable side wall and toward which the at least one spring lock insert is biased and a release position, wherein the main flame comprises at least one latch opening corresponding to the at least one spring lock insert, the latch opening receiving the spring lock insert when the pivotable side wall is in the opened position, wherein the spring lock insert comprises a pair of spring extensions disposed at a diverging angle relative to a bias direction of the spring lock insert and toward the lock portion, wherein a width of the slot in the pivotable side wall is smaller than a width span of the spring extensions, wherein the spring extensions are deflectable inward to enable the spring lock insert to be displaced downward away from the lock position, and wherein the spring extensions extend through sidewalls of the slot.

5. A collapsible container according to claim 1, wherein the pivotable side wall comprises a release channel disposed adjacent the slot, the release channel housing the spring lock insert and including sufficient space to enable the spring lock insert to be displaced in the slot from the lock position to the release position.

6. A collapsible container according to claim 1, wherein the plurality of side walls comprises two lateral walls and two end walls, the end walls being pivotable between the collapsed position and the opened position.

7. A collapsible container according to claim 6, wherein each of the end walls comprises two spring lock inserts secured in corresponding slots therein, and wherein the main frame comprises a latch opening for each of the spring lock inserts.

* * * * *